United States Patent [19]

Cremonese

[11] Patent Number: 4,940,189

[45] Date of Patent: Jul. 10, 1990

[54] CONTAINER

[76] Inventor: Henry V. Cremonese, 125 Christopher St. #2H, New York, N.Y. 10014

[21] Appl. No.: 226,786

[22] Filed: Aug. 1, 1988

[51] Int. Cl.[5] ..... B65D 5/36

[52] U.S. Cl. ..... 229/1.5 B; 141/337; 210/497.2; 210/497.3

[58] Field of Search ..... 229/1.5 B, 1.5 R, 116, 229/115, 104, 107; 141/337, 338; 210/497.3, 497.2

[56] References Cited

U.S. PATENT DOCUMENTS

| | | | |
|---|---|---|---|
| 952,313 | 3/1910 | Droz | 141/337 |
| 992,210 | 5/1911 | Klin | 229/1.5 B |
| 1,020,617 | 3/1912 | Matthews | 229/1.5 B |
| 1,048,583 | 12/1912 | Reichenbach | 229/1.5 B |
| 1,134,916 | 4/1915 | Sharon | 229/1.5 B |
| 1,355,866 | 10/1920 | Stubbs | 229/68 R |
| 1,552,524 | 9/1925 | Weckbaugh | 229/1.5 B |
| 1,558,602 | 10/1925 | Fischer | 229/1.5 B |
| 1,810,806 | 6/1931 | Wilson | 229/1.5 B |
| 2,100,888 | 11/1937 | Vine | 141/337 |
| 2,131,003 | 9/1938 | Lucia | 229/1.5 B |
| 2,220,110 | 11/1940 | Layton | 229/115 |
| 2,321,639 | 6/1943 | Zarbo | 141/331 |
| 2,688,914 | 9/1954 | Eckler | 229/DIG. 14 |
| 2,761,448 | 9/1956 | Monroe | 229/1.5 B |
| 3,017,063 | 1/1962 | Rooney | 229/1.5 R |

*Primary Examiner*—Stephen Marcus
*Assistant Examiner*—Jes F. Pascua
*Attorney, Agent, or Firm*—Robert H. Montgomery

[57] ABSTRACT

A container comprising a base member of generally circular form where two side panels are defined on fold lines which are first and second chords of the base panel and are folded over and affixed to each other to define a pocket with a base panel, another panel is defined on the base panel by fold line which is a chord substantially co-terminal with the first and second chords.

3 Claims, 2 Drawing Sheets

CONTAINER

FIELD OF THE INVENTION

This invention relates to a utilitarian container which may be used for food products or the like.

BACKGROUND OF THE INVENTION

It is well known in the art to provide containers for food products, water or the like, which may be developed from a base panel having various fold lines wherein some of the parts of the panel may be connected to other parts after the fold lines are defined.

In many of these devices, a specially formed blank or base panel must be cut from material and then fold lines defined thereon, so that the device may be fabricated into its ultimate shape. This may lead to a waste in material when the initial blanks are cut from large pieces of stock prior to being fabricated or conformed to the usual shape.

Accordingly, the present invention provides an easily fabricated or formed container which may be initially defined as a circular blank with predetermined fold lines thereon.

SUMMARY OF THE INVENTION

Briefly stated, the invention in one form thereof comprises a container which is formed from a substantially circular blank with fold lines defined therein. The blank is initially formed as substantially circular and two fold lines are defined on chords of the blank which are substantially the sides of an isosceles triangle. A further fold line is defined on a chord which is essentially the base of the isosceles triangle. The first two chords are folded upon one another and the two panels defined by these chords are adhered or affixed to each other. This forms a pocket with respect to the remainder of the panel. The fold line of the third panel, which is the base of the isosceles triangle, may be utilized as a partial closure for the pocket, or an extension of the base panel for supporting a substance in the pocket. Additionally, small panels are formed by fold lines on the first two panels which may be folded back to provide buffers against egress of any of the contents of the pocket.

A container embodying the invention is particularly useful in the serving or dispensing of food and not only provides a pocket or container for the food, but an extending tray-like portion for the food as it is removed from the pocket.

An object of this invention is to provide a new and improved disposable container which may be stored in an unused position in a flat configuration.

Another object of this invention is to provide a new and improved container which may be held in one hand and flexed to fill the container with a substance and permit easy removal of the substance therefrom.

A further object of this invention is to provide a new and improved container which may be utilized for food to be held in one hand while an implement such as a spoon, fork or possibly chopsticks may be utilized with the other hand to remove the food from the container.

The features of the invention which are believed to be novel are particularly pointed out and distinctly claimed in the concluding portion of the specification. The invention, however, together with further objects and advantages thereof, may best be appreciated by reference to the following detailed description taken in conjunction with the drawings.

DETAILED DESCRIPTION OF THE PREFERRED EMBODIMENT OF THE INVENTION

Figure 1:
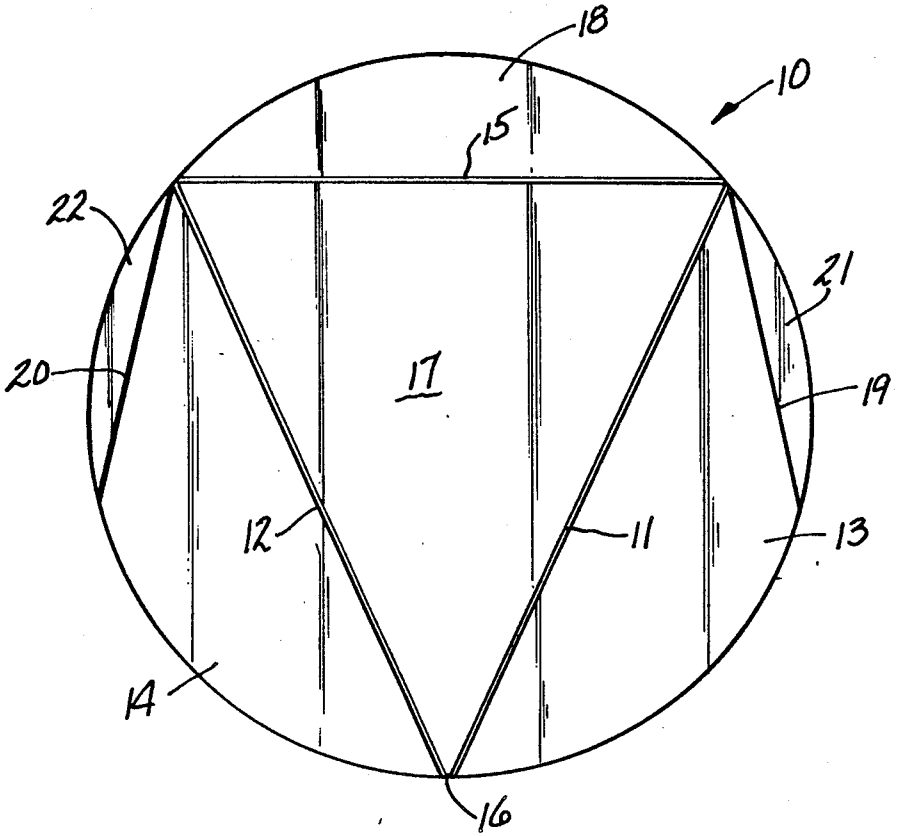
FIG. 1 is a plan view of a panel which may be formed into a container embodying the invention.

FIG. 1 shows a circular panel or blank 10 from which a container embodying the invention is formed. The panel or blank 10 is formed with chordial fold lines 11 and 12 which, with the perimeter of base panel 10, define side panels 13 and 14, respectively. A further fold line 15 is essentially co-terminal with the upper ends of fold lines 11 and 12. The fold lines 11 and 12 are essentially co-terminal at point 16. It will be noted that the fold lines 11, 12 and 15 substantially define a base panel 17 in substantially the form of an isosceles triangle. A further panel 18 is defined by fold line 15 and the perimeter of the panel 10.

Further chordial fold lines 19 and 20 are defined on panels 13 and 14, respectively, and further define lips 21 and 22, respectively.

Figure 2:
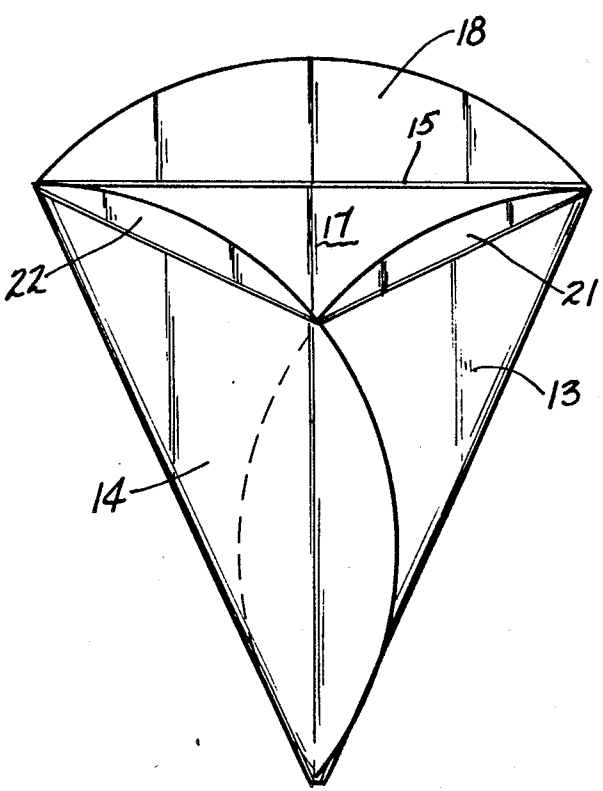
FIG. 2 is a view of the panel of FIG. 1 after it has been formed into a container embodying the invention.

FIG. 2 exemplifies the assembled container and it will be noted that panel 14 is folded over on panel 13 and is adhered or otherwise affixed thereto. Panel 18 extends from the container and may be bent over to provide a partial closure. The lips 21 and 22 are bent out or folded in the reverse direction to the other folds along lines 11, 12 and 15.

Figure 3:
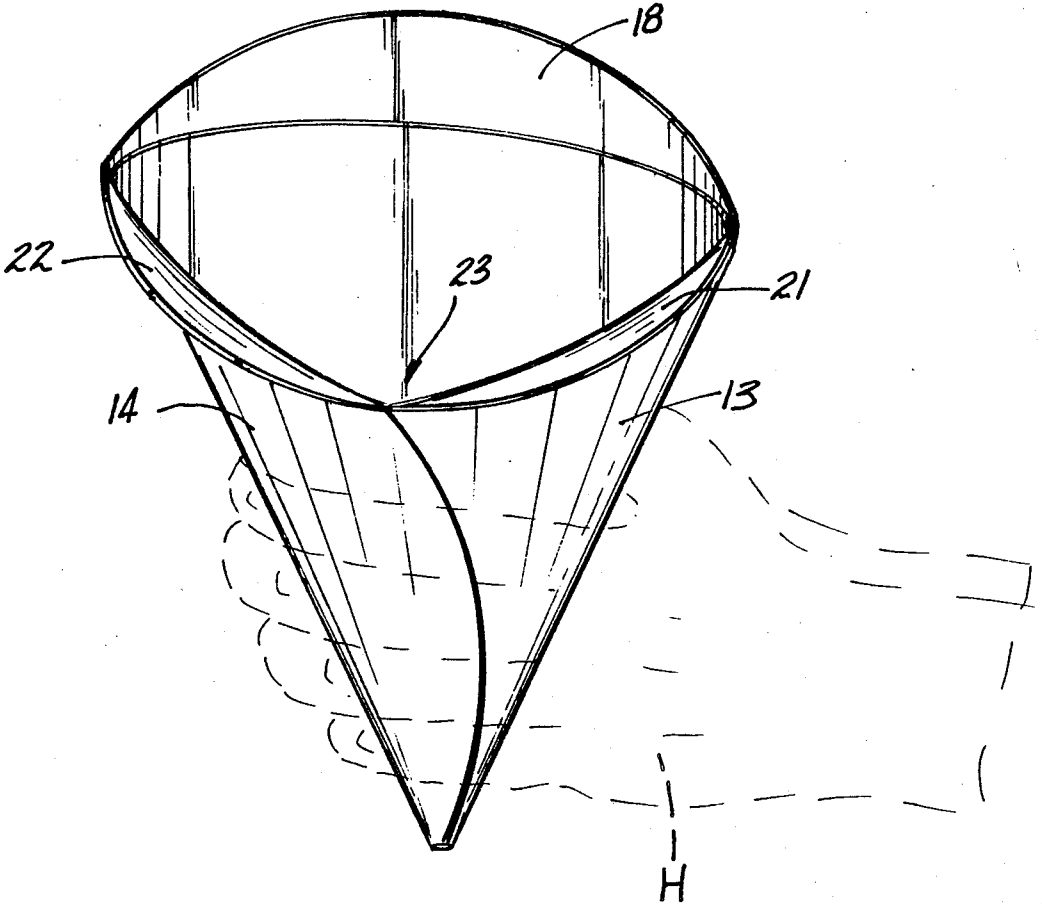
FIG. 3 is a view in perspective illustrating how a container embodying the invention may be utilized.

FIG. 3 is a perspective view of the container showing it flexed out by a hand H.

As shown in FIG. 3, the container defines an interior pocket 23 which may receive food or other substance. Panel 18 defines an extension of base panel 17 and pocket 23 and provides further area for support for the contents of pocket 23. The lips 21 and 22, as shown in FIG. 3, may form buffers against possible loss of any of the contents of the pocket 23, as the contents may be removed by an eating utensil such as a spoon, fork or chopsticks.

The disclosed container is easily stored flat in the form shown in FIG. 2 and may be opened by flexing the formed container along the fold lines 11 and 12, as shown in FIG. 3.

Containers embodying the invention may also be utilized for other purposes, as for example a child's toy, such as a sand scoop. The containers may also be used as a teaching aid for young children learning to identify various objects and colors. Panel 18 may be folded over to at least partially close pocket 23 and store food which is not fully consumed. The panel 18 may be bent over the lips 21 and 22 to provide a closure for pocket 23.

It may thus be seen that the objects of the invention set forth, as well as those made apparent from the foregoing description, are efficiently attained. While a preferred embodiment of the invention has been set forth for purposes of disclosure, modifications to the disclosed embodiments of the invention, as well as other embodiments thereof, may occur to those skilled in the art. Accordingly, the appended claims are intended to cover all embodiments of the invention and modifications to the disclosed embodiments which do not depart from the spirit and scope of the invention.

Having thus described the invention, what is claimed is:

1. A container formed from a blank of generally circular form, two side panels folded over along fold lines which define first and second chords of said generally circular form, said side panels being affixed to each other to define a pocket having a base panel, another panel defined on said base panel by a third fold line which defines a third chord of said generally circular form and which is substantially co-terminal with said first and second chords.

2. The container of claim 1 where said first, second and third chords substantially define said base panel as an isosceles triangle.

3. The container of claim 1 where said two side panels have free upper ends and lips defined by said upper ends and fourth and fifth fold lines, said fold lines defining forth and fifth chords of said generally circular form.

* * * * *